US009221522B2

(12) United States Patent
Mohrfeld

(10) Patent No.: US 9,221,522 B2
(45) Date of Patent: Dec. 29, 2015

(54) VENT CAP SYSTEM FOR A SUCTION PILE

(71) Applicant: Austin Theodore Mohrfeld, Tomball, TX (US)

(72) Inventor: Austin Theodore Mohrfeld, Tomball, TX (US)

( * ) Notice: Subject to any disclaimer, the term of this patent is extended or adjusted under 35 U.S.C. 154(b) by 193 days.

(21) Appl. No.: 14/149,618

(22) Filed: Jan. 7, 2014

(65) Prior Publication Data

US 2015/0191220 A1 Jul. 9, 2015

(51) Int. Cl.
*B63B 21/27* (2006.01)
*B63B 35/44* (2006.01)

(52) U.S. Cl.
CPC ..... *B63B 21/27* (2013.01); *B63B 35/4413* (2013.01); *Y10T 29/4984* (2015.01)

(58) Field of Classification Search
CPC ..... B63B 21/27
USPC ..... 405/224, 224.1; 114/296
See application file for complete search history.

(56) References Cited

U.S. PATENT DOCUMENTS 5,704,732 A * 1/1998 Horton, III ..... B63B 21/26 114/296
6,122,847 A 9/2000 Treu et al.
6,322,439 B1 11/2001 David
6,457,908 B1 * 10/2002 Bergeron ..... B63B 21/04 114/230.1
6,692,194 B2 * 2/2004 Strand ..... E21B 7/12 114/296
6,719,496 B1 4/2004 Von Eberstein
7,621,059 B2 * 11/2009 McCoy, Jr. ..... E02F 3/905 114/296
8,021,082 B2 9/2011 Thomas et al.
2005/0201835 A1 * 9/2005 Alliot ..... B63B 21/27 405/226
2006/0127187 A1 6/2006 Raines et al.
2008/0292409 A1 11/2008 Alhayari
2009/0297276 A1 12/2009 Foo et al.
2012/0006557 A1 1/2012 Fraser et al.
2012/0024535 A1 2/2012 Lieske, II
2013/0220206 A1 8/2013 Mogedal et al.
2014/0109486 A1 * 4/2014 Nolle ..... E02D 29/14 49/503
2014/0237902 A1 * 8/2014 David ..... B65D 90/10 49/465

FOREIGN PATENT DOCUMENTS

WO WO2015043856 a1 * 4/2015

* cited by examiner

*Primary Examiner* — Sunil Singh
(74) *Attorney, Agent, or Firm* — Andrew W. Chu; Craft Chu PLLC

(57) ABSTRACT

A vent cap system includes a top plate, a center stem assembly, a retainer assembly attached to the top plate, a bottom plate, a flange assembly with a connection end for installation on a suction pile and a plurality of perimeter stem assemblies. The center stem assembly extends from the top plate, through threaded engagement to the retainer assembly, and to the bottom plate. Rotation of the center stem assembly moves the bottom plate between opened and closed positions, relative to the top plate and flange assembly. The perimeter stem assemblies hold the relative position of the top plate to the flange assembly, and the bottom plate seals against the flange assembly, when the system is in the closed position. The bottom plate has a bottom alignment pin to assure alignment of the bottom plate to the flange assembly for any orientation of the vent cap system.

20 Claims, 5 Drawing Sheets

VENT CAP SYSTEM FOR A SUCTION PILE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to anchors for off-shore facilities, such as drilling rigs. More particularly, the present invention relates to a vent cap system for a suction pile. Even more particularly, the present invention relates to a vent cap system with alignment for opening and closing in any orientation and with a verifiable seal.

2. Description of Related Art Including Information Disclosed Under 37 CFR 1.97 and 37 CFR 1.98.

A suction pile (also known as a suction caisson, a suction anchor, and a suction bucket) is used to moor a subsea drilling rig to the ocean floor. The suction pile is attached to the ocean floor, and rig structures are anchored to the attached suction pile. The suction pile is comprised of a generally tubular body, dropped into the water and floated down to the ocean floor. The open end of the tubular body embeds into the ocean floor, like an upside down bucket faced down in the soil. There is a closed end of the tubular body with a vent hatch. The vent hatch has an opened position and a closed position, and a remote operated vehicle (ROV) is used to move the vent hatch between these two positions. The opened position is used during deployment to the ocean floor, with water flowing through the tubular body by the vent hatch. Once landed, tubular body self-embeds into the ocean floor by sheer weight and momentum upon reaching the ocean floor. The suction pile is partially embedded when landed. For complete embedding, the closed position is used to seal the suction pile, so that air and water remaining in the tubular body are pumped out. An ROV can attach a hose to a suction port on the tubular body. Soil of the ocean floor is further sucked into the tubular body, solidly embedding the suction pile onto the ocean floor to a desired depth. The ROV removes hose and seals the suction port.

The completely embedded and at least partially filled suction pile forms a solid base for mooring a drilling rig structures. Suction piles as anchoring means for rigs and other oil and gas exploration installations are known. The suction pile may also function as a foundation for manifolds. A manifold can be set on top of the suction pile or a plurality of suction piles. Thus, the manifold is installed in a subsea location for access to multiple wells. The manifold on the suction pile can maintain multiple production flowline headers at a subsea location. For the suction pile as an anchor for a rig or foundation for a manifold, the vent hatch remains closed and sealed on the suction pile.

Variations of suction piles are known in the prior art. For example, United States Patent Publication No. 20060127187, published for Raines on Jun. 15, 2006, discloses a conventional anchor system with a variation on the suction pile structure. There is an elongated hollow anchor element releasably attached to an installation element.

The use of ROV technology to facilitate the embedding of a suction pile is also well known. United States Patent Publication No. 20090297276, published for Foo et al., on Dec. 3, 2009 discloses installation using the ROV instead of an aiming mechanism on the anchoring element of the suction pile. U.S. Pat. No. 6,719,496, issued to Eberstein on Apr. 13, 2004, also describes a system with ROV intervention to install a suction pile. The ROV with pump capability closes the flood valves on the top of the suction pile and attaches to the pumping port of the suction pile. The pump of the ROV operates to draw down the suction pile. The ROV disconnects from the pump port and connects a mooring line to second the load connection.

Variations of the vent hatch or vent cap of the suction pile are also known in the prior art. The primary type of vent hatch for a suction pile is the hinged cap. United States Patent Publication No. 20130220206, published for Mogedal et al on Aug. 29, 2013, shows a vent cap as a hinged cap with a frame to insure alignment of the cap plate over the hatch. Another type of vent hatch is the butterfly valve, shown in U.S. Pat. No. 6,719,496, issued to Eberstein on Apr. 13, 2004, with a cap plate swiveling over the hatch for opening and closure. Some vent hatches are combinations of the hinged cap and the butterfly valves, such as U.S. Pat. No. 6,322,439, issued to David on Nov. 27, 2001. The hinge elements transition between the traditional flipping hinged cap with the cap plate lifted from the hatch and the traditional butterfly vent cap with the cap plate swiveling over the hatch.

It is an object of the present invention to provide an embodiment of a vent cap system for a suction pile.

It is an object of the present invention to provide an embodiment of a vent cap having a closed position and an opened position.

It is still another object of the present invention to provide an embodiment of a vent cap being actuated between the closed position and the opened position by an ROV.

It is still another object of the present invention to provide an embodiment of a vent cap being actuated between the closed position and the opened position in both a horizontal orientation and a vertical orientation.

It is still another object of the present invention to provide an embodiment of a vent cap with alignment of the plate to seal the vent hole in any orientation.

It is yet another object of the present invention to provide an embodiment of a vent cap with improved handling for an ROV.

It is yet another object of the present invention to provide an embodiment of a vent cap with improved seals.

It is yet another object of the present invention to provide an embodiment of a vent cap with a means for verifying the seal of the vent hole.

It is yet another object of the present invention to provide an embodiment of a vent cap with replaceable parts.

These and other objects and advantages of the present invention will become apparent from a reading of the attached specification and appended claims.

SUMMARY OF THE INVENTION

Embodiments of the present invention include a vent cap system being comprised of a top plate, a center stem assembly, a retainer assembly, a bottom plate, a flange assembly and a plurality of perimeter stem assemblies. The top plate has a center top plate hole. The center stem assembly is comprised of a center stem handle, and a threaded center stem bolt body extending through the center top plate hole. The retainer assembly holds the center stem assembly to the top plate. The center stem handle is comprised of gripping members and a housing cover, which extends above the top plate for access by an ROV.

Embodiments of the bottom plate have a stem retainer, a bottom alignment pin and a sealing means. The stem retainer is centered on a top surface of the bottom plate and removably attaches to a terminal end of the threaded center stem bolt body. The threaded center stem bolt body connects the top plate to the bottom plate, and the bottom plate moves relative to the top plate. Actuating the threaded center stem bolt body by rotating the center stem handle by an ROV. The threaded center stem bolt body is attached by the stem retainer.

The flange assembly has a connection end and a flanged end. The connection end is made integral with the suction pile. The connection end covers the vent hole in the suction pile. The flanged end faces and removably engages the bottom plate for the transition between closed position and opened position of the vent cap system. The flange assembly has a rod guide comprised of a frame with a center frame hole. The bottom alignment pin extending from the bottom plate inserts through the center frame hole to assure alignment of the bottom plate into the flanged end. The sealing means on the bottom plate engages the flanged end to form the seal in the closed position of the vent cap. The sealing means can be an O-ring, which can be tested through a pipe plug in the flanged end of the flange assembly.

A plurality of perimeter stem assemblies is arranged on a perimeter of flanged end of the flange assembly so as to maintain position of the top plate relative to the flange assembly during raising and lowering of the bottom plate between an opened position and a closed position. Each perimeter stem assembly is comprised of perimeter stem handle, perimeter stem bolt body, retaining screw, and a spacer. Each spacer keeps the top plate in position relative to the flange assembly. An ROV can rotate each perimeter stem handle to unscrew the flange assembly from the vent cap system.

The present invention also includes embodiments of a method of forming a suction pile assembly with a vent cap system. The suction pile assembly is comprised of a generally cylindrical body with a top pile surface with vent holes on a closed end and a skirt on an opened end. At least one vent hole on a top pile surface with the vent cap system is covered by placement of the connection end of the flange assembly. The flange assembly is made integral with the cylindrical body, and the top and bottom plates of the vent cap system are aligned for sealed engagement between the bottom plate and the flange assembly. The threaded center stem bolt body is actuated by an ROV between an opened position and a closed position of the vent cap system according status of installation of the cylindrical body on the ocean floor. After the suction pile is completely embedded, the vent cap system can remain closed and sealed. The suction pile can be used as an anchor or foundation for off-shore and subsea installations. In cases of failure to seal, the top plate, center stem assembly, retainer assembly, bottom plate and perimeter stem assemblies can be separated from the flange assembly. A new vent cap system with a different bottom plate and without a flange assembly or an emergency cover can be used to seal in the completely embedded stage, when the seal is not important for pumping. In cases of failure to seal before pumping, a new vent cap system with a different bottom plate and without a flange assembly can be used, and the seal of the different bottom plate will require verification and testing before the pumping activity.

DETAILED DESCRIPTION OF THE DRAWINGS

Referring to FIGS. 1-9, embodiments of the present invention include a vent cap system 10 for a suction pile of an off-shore facility, such as a drilling rig or a foundation for a manifold. The suction pile is lowered to the sea floor with the vent cap system 10 in the opened position, and the suction pile is completely embedded with the vent cap system 10 in the closed position. The opened position allows water to pass through the vent hole in the suction pile, as the suction pile descends to the ocean floor. The suction pile self-embeds by sheer weight and momentum upon reaching the ocean floor. For completely embedding or embedding to a desired height, the closed position seals the suction pile so that a pump can vacuum soil and sand on the ocean floor into the interior of the suction pile to a desired level, forming a stable anchor or foundation on the ocean floor. The vent cap system 10 transitions between opened and closed positions in any orientation of the suction pile. Once the suction pile is completely embedded as an anchor for structures of the off-shore facility or as a foundation for a manifold, the vent cap system 10 remains closed and sealed on the suction pile. In cases of failure to seal, the vent cap system 10 can be partially disassembled and replaced with an emergency cover or a different bottom plate of a partially new vent cap system. An ROV facilitates the transition from opened position to closed position of the vent cap system, activation of a suction pump to embed the suction pile, and the partial disassembly of the vent cap system.

Figure 1:
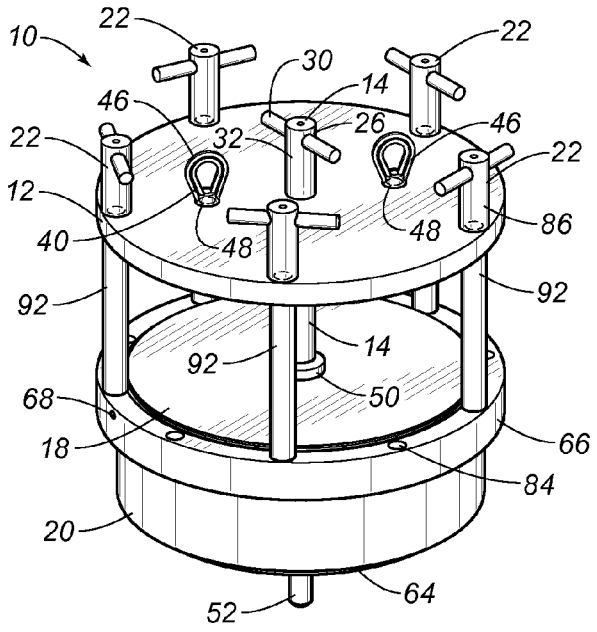
FIG. 1 is an upper perspective view of an embodiment of the vent cap system of the present invention, showing a closed position.
Figure 2:
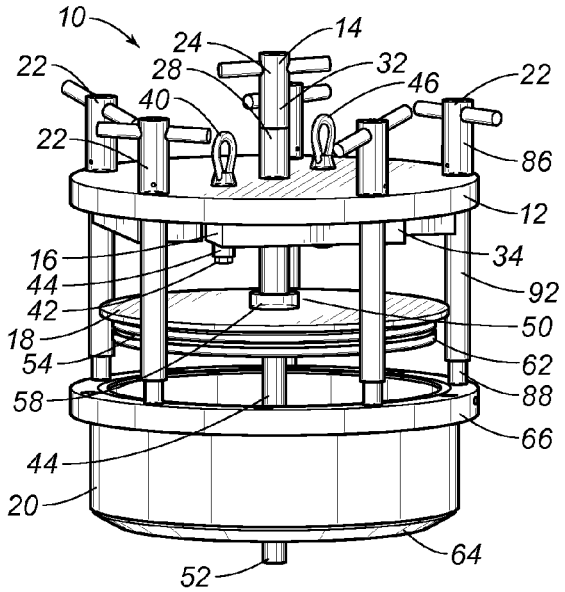
FIG. 2 is a side perspective view of the embodiment of FIG. 1, showing an opened position.
Figure 3:
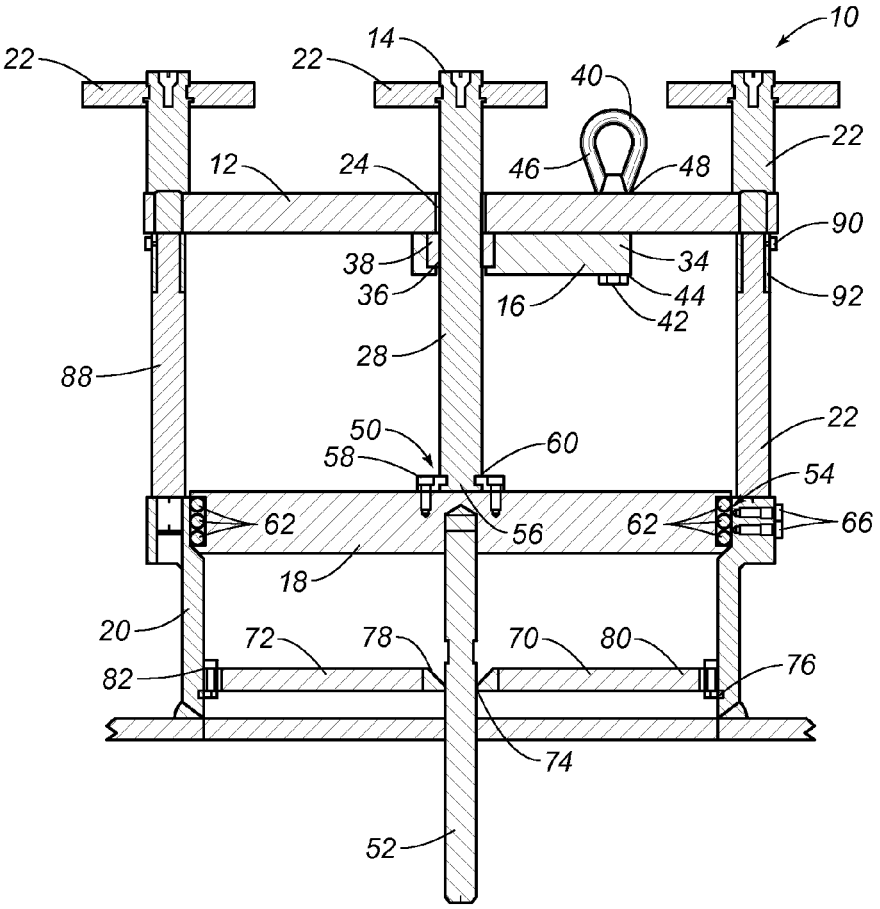
FIG. 3 is a sectional view of an embodiment of the vent cap system of the present invention, showing a closed position.

FIGS. 1-3 show an embodiment of the vent cap system 10 having a top plate 12, a center stem assembly 14, a retainer assembly 16, a bottom plate 18, a flange assembly 20 and a plurality of perimeter stem assemblies 22.

The top plate 12 has a center top plate hole 24. The center stem assembly 14 is comprised of a center stem handle 26, and a threaded center stem bolt body 28 extending through the center top plate hole 24. The center stem handle 26 can be comprised of gripping members 30 and a housing cover 32, which extends above the top plate 12 for access by an ROV.

The gripping members 30 are easily grasped by an ROV. The housing cover 32 maintains position above the top plate 12 in both the closed and opened positions of the vent cap system 10. The ROV maintains access to the center stem assembly 14 in any position. The threaded center stem bolt body 28 extends through the top plate 12.

In some embodiments, the retainer assembly 16 holds the center stem assembly 14 to the top plate 12. The retainer assembly 16 is comprised of a nut retainer plate 34 with a retainer center hole 36, and a stem nut 38 disposed in the retainer center hole 34. The stem nut 38 is threaded and in threaded engagement with the threaded center stem bolt body 28. Rotating the threaded center stem bolt body 28 through the stem nut 38 controls movement of the center stem assembly 14 through the top plate 12. Thus, there is threaded engagement of the center stem assembly 14 by the nut retainer plate 34 in the retainer center hole 36.

In other embodiments, the retainer assembly 16 provides the lifting means 40 for the vent cap system 10. The retainer assembly 16 further comprises an eye nut 42 and eye nut hole 44 in the nut retainer plate 34. The eye nut 42 fixedly engages the nut retainer plate 34 to an underside of the top plate 12. There can be screw thread engagement through the top plate 12 in eye nut holes 48 in the top plate 12, such that the top plate 12 is sandwiched between the nut retainer plate 34 and the eye nut 42 above the top plate 12. The handle 46 of the eye nut 42 on a top side of the top plate can be used for lifting by a crane or other device for placement of the vent cap system 10 in the water or for storage. An ROV may also be able to engage the handle 46 of the eye nut 42. The retainer assembly 16 strengthens stability of the center stem assembly 14 through the top plate 12. All center holes and structures, including but not limited to center top plate hole 24, threaded center stem bolt body 28, and the retainer center hole 36, are aligned together on a single axis. The retainer assembly 16 as the lifting means also preserves the center stem assembly 14 for the opening and closing functions. There is less chance of damage to the structures and alignment for opening and closing because the retainer assembly 16 bears the function of lifting and moving the vent cap system 10.

The vent cap system 10 further comprises embodiments of the bottom plate 18 with a stem retainer 50, a bottom alignment pin 52 and a sealing means 54. The stem retainer 50 is centered on a top surface of the bottom plate 18 and attaches to a terminal end 56 of the threaded center stem bolt body 28. In some embodiments, the stem retainer 50 is comprised of arc shaped flange pieces 58 in screw fit engagement around the terminal end 56 of the threaded center stem bolt body. The shoulders 60 of the flange pieces 58 friction fit against the terminal end 56 of stem assembly 14, holding the bottom plate 18 attached to the threaded center stem bolt body 28. Thus, the threaded center stem bolt body 28 connects the top plate 12 to the bottom plate 16, and the bottom plate 18 moves relative to the top plate 12 by rotating the threaded center stem bolt body 28 by the center stem handle 26 by an ROV or other device. FIGS. 2 and 3 show the sealing means 54 as O-rings 62 or a plurality of O-rings 62 along an outer circumference of the bottom plate 18. Each O-ring forms a liquid-tight seal of the bottom plate 18 against the flange assembly 20. O-rings 62 may be adjacent or stacked or both on the outer circumference of the bottom plate 18. The seal withstands pressure sufficient to pump out water from the suction pile, filling the suction pile with sand and soil from the ocean floor to the desired level within the suction pile.

FIGS. 1-3 also show the bottom alignment pin 52 in alignment with the threaded center stem bolt body 28 and the center top plate hole 24. The bottom alignment pin 52 extends downward from the bottom plate 18 and is made integral with bottom plate 18 by means included but not limited to screw fit, friction fit and welding/forging to the bottom plate.

Embodiments of the flange assembly 20 have a connection end 64 and a flanged end 66. The connection end 64 is oriented adjacent a suction pile for installation on the suction pile. The connection end 64 covers the vent hole in the suction pile and can be made integral with the suction pile by welding or other means. The flanged end 66 faces and removably engages the bottom plate 18 for the transition between closed position and opened position of the vent cap system 10. The sealing means 54 on the bottom plate 18 engages the flanged end 66 to form the seal in the closed position of the vent cap system 10. The sealing means 54 can be at least one O-ring 62, which can be tested through a pipe plug 68 or plurality of pipe plugs 68 in the flange assembly 20. FIG. 3 shows the pipe plugs 68 as test ports for evaluating seals of the O-rings 62. The pipe plugs 68 can be spaced between O-rings 62 for testing each O-ring 62 for the overall seal. The testing allows confirmation that the vent cap system 10 in the closed position can handle the pressure needed to pump out water and suction soil into the suction pile.

Figure 7:
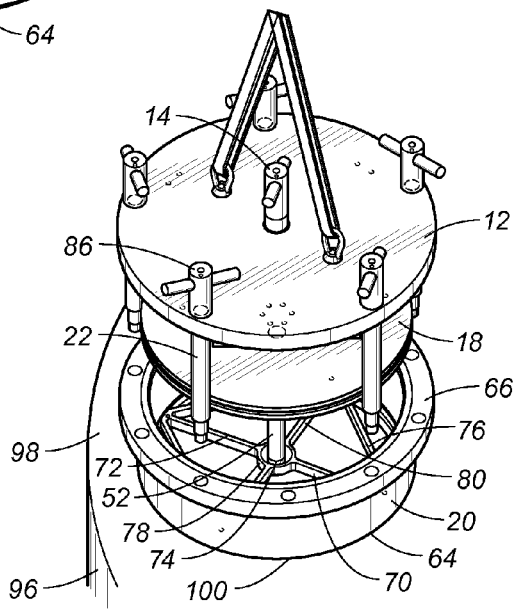
FIG. 7 is another exploded perspective view of an embodiment of the vent cap system of the present invention, showing alignment of the bottom plate to the flange assembly.

FIGS. 3 and 7 show embodiments of the flange assembly 20 with a rod guide 70 comprised of a frame 72 with a center frame hole 74. The rod guide 70 is disposed within the flange assembly 20 toward the connection end 64. The center frame hole 74 is aligned with the bottom alignment pin 52 of bottom plate 18 for insertion through the center frame hole 74. The bottom alignment pin 52 extending from the bottom plate 18 inserts through the center frame hole 74 to assure alignment of the bottom plate 18 into the flanged end 66. The vertical or horizontal orientation of the vent cap system 10 does not affect the ability of the ROV to open and close the vent cap system 10 properly. In some embodiments, the frame 72 of the rod guide 70 is comprised of an outer rim 76 and an inner rim 78 forming the center frame hole 74. A plurality of elongate members 80 connects the inner rim 78 to outer rim 76 as shown in FIG. 7. FIG. 3 also shows an embodiment with a plurality of rod guide mounts 82 attached to interior of flange assembly 20 for mounting the frame 72 in the flange assembly 20. The frame 72 is in screw threaded engagement at the rod guide mounts 82 so as to fix position of the frame 72 within the flange assembly 20. The rod guide 70 is positioned closer to connection end 64 than the flanged end 66.

FIGS. 1-3 shows embodiments of the plurality of perimeter stem assemblies 22 arranged on a perimeter 84 of flanged end 66 of the flange assembly 20 so as to maintain position of the top plate 12 relative to the flange assembly 20 during raising and lowering of the bottom plate 18 between an opened position and a closed position of the vent cap system 10. Each perimeter stem assembly 22 is comprised of perimeter stem handle 86, perimeter stem bolt body 88, retaining screw 90, and a spacer 92. Each spacer 92 is like a sleeve, keeping the top plate 12 in position relative to the flange assembly 20, and each perimeter stem bolt body 88 is housed within a respective spacer 92. Each perimeter stem handle 86 is mounted above the top plate so as to allow access by an ROV to unscrew the perimeter stem assemblies 22, separating the flange assembly 20 from the vent cap system 10. Each perimeter stem bolt body 88 has a perimeter stem handle 86 on one end above the top plate 12 and extends from the perimeter stem handle 86 through top plate 12 to the flange assembly 20. Each perimeter stem bolt body 88 includes an engagement end in removable threaded engagement with the flange assembly 20. An ROV rotates the perimeter stem handle 86, just as the center stem handle 26.

FIGS. 4-9 shows embodiments of the method of forming a suction pile assembly with a vent cap system 10, according to the present invention. The suction pile assembly 94 is comprised of a generally cylindrical body 96 with a top pile surface 98 with vent holes 100 on a closed end 102 and a skirt (not shown) on an opened end. These embodiments are methods of using the base invention of the vent cap system 10 on a suction pile assembly 94.

Figure 4:
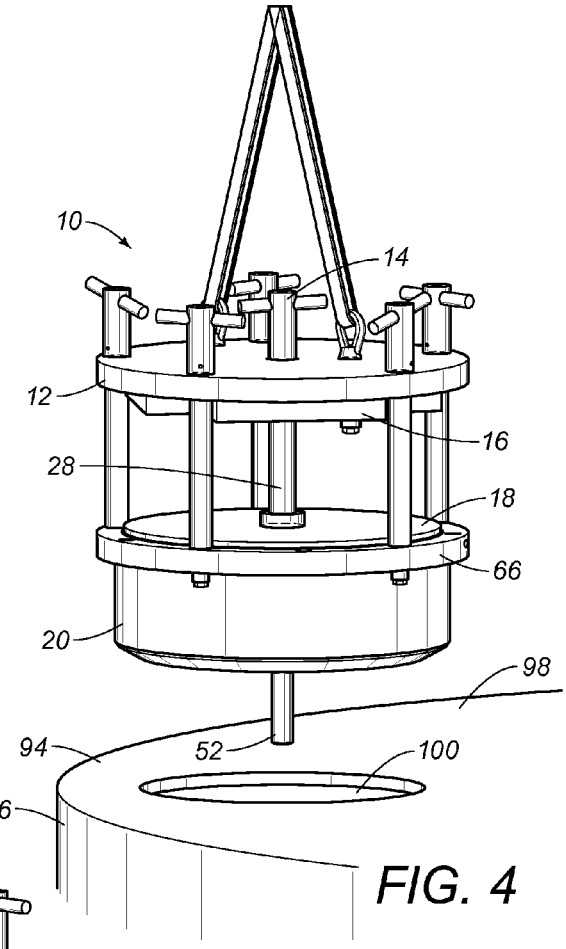
FIG. 4 is a perspective view of an embodiment of the vent cap system of the present invention, showing installation on a suction pile.
Figure 5:
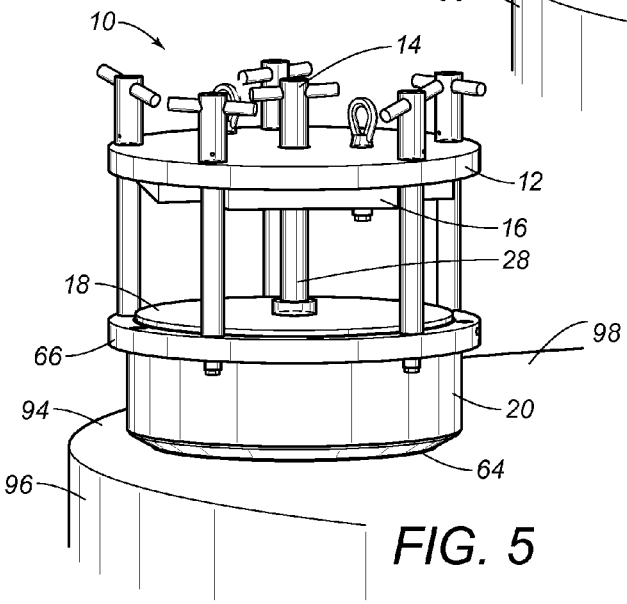
FIG. 5 is another perspective view of an embodiment of the vent cap system of the present invention, showing a connection end made integral with the suction pile.

Embodiments of the method include covering at least one vent hole 100 on a top pile surface 98 with the vent cap system 10 by placement of the connection end 64 of the flange assembly 20, as shown in FIGS. 4 and 5. The flange assembly 20 is made integral with the cylindrical body 96, and the top 12 and bottom plates 18 of the vent cap system 10 are aligned for sealed engagement between the bottom plate 18 and the flange assembly 20.

Figure 6:
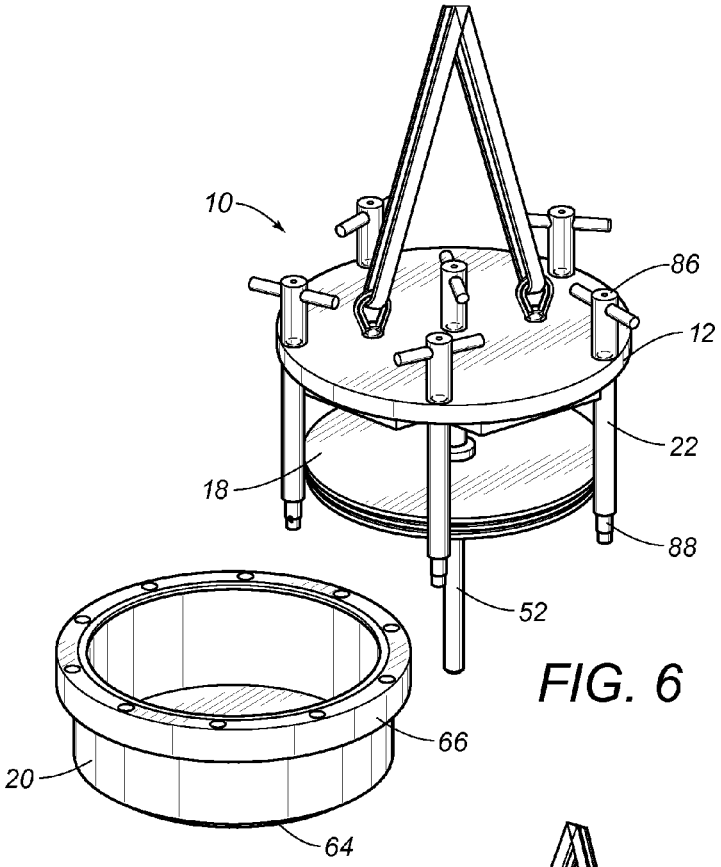
FIG. 6 is an exploded perspective view an embodiment of the vent cap system of the present invention, showing separation of the flange assembly.

FIG. 6 shows the step of separating the perimeter stem assemblies 22 from the flanged end 66 of the flange assembly 22. The perimeter stem handles 86 above top surface of the top plate 12 can be rotated by an ROV or other device for threaded release of each perimeter stem bolt body 88. The top plate 12, center stem assembly 14, retainer assembly 16, and bottom plate 18 are separated from the flange assembly 20. On the suction pile assembly 94 alone, the flange assembly 20 can be made integral with the top pile surface 98 around a vent hole 100 on the connection end 64. Welding, fixed engagement, painting, and coatings can take place to fix the flange assembly 20 to the cylindrical body 96. Once fixed, the vent cap system 10 is re-assembled in FIG. 7. The perimeter stem assemblies 22 re-engage the flanged end 66 of the flange assembly 20. The perimeter stem handles 86 above top surface of the top plate 12 can be rotated by an ROV for threaded re-attachment of each perimeter stem bolt body 88. The bottom alignment pin 52 inserts through the center frame hole 74 of the rod guide 70 in FIG. 7. There is one alignment and one correct orientation to insure alignment of the bottom plate 18 to the flange assembly 20 and each perimeter stem assembly to the flanged end 66.

Figure 8:
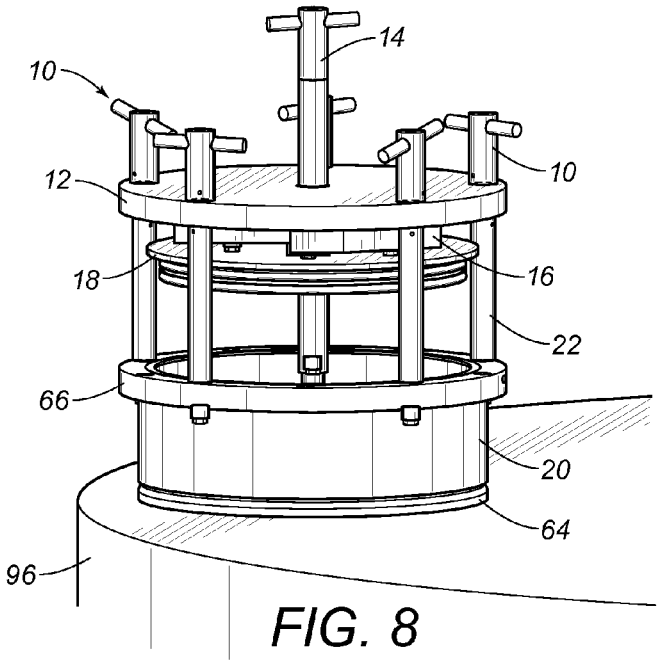
FIG. 8 is a perspective view of an embodiment of the vent cap system of the present invention, showing an opened position on the suction pile.
Figure 9:
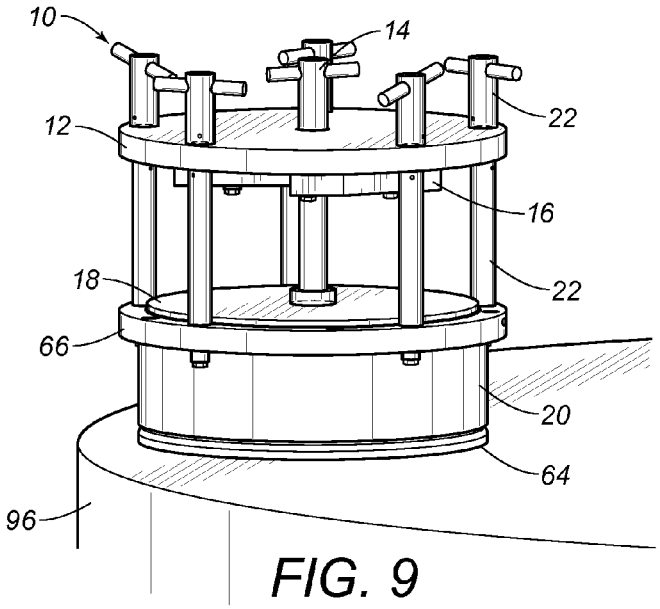
FIG. 9 is a perspective view of the embodiment of the vent cap system of FIG. 8, showing a closed position on the suction pile.

FIGS. 8 and 9 show the steps of actuating the threaded center stem bolt body 28 of the center stem assembly 14 by an ROV between an opened position and a closed position of the vent cap system 10 according status of installation of the cylindrical body 96 on the ocean floor. The suction pile assembly 94 is deployed into the water with the vent cap system 10 in the opened position so that water flows through the cylindrical body 96. The skirt on the open end partially embeds onto the ocean floor by sheer weight and momentum of the suction pile assembly 94 sinking. Then, the threaded center stem bolt body 28 lowers the bottom plate 18 to engage the flanged end 66 of the flange assembly 22 for the closed position of the vent cap system 10. The suction pile is completely embedded or embedded to the desired level, when water is pumped from the cylindrical body 96 and soil and sand are sucked into the cylindrical body 96. The vent cap system 10 remains in the closed position in the completed embedded state, while the suction pile assembly 94 functions as an anchor for an off-shore facility, as a foundation for a subsea manifold, or a support structure for other installations.

In cases of failure to seal or a ruptured seal, the top plate 12, center stem assembly 14, retainer assembly 16, bottom plate 18 and perimeter stem assemblies 22 can be separated from the flange assembly 20. An emergency cover can replace a bad seal of the bottom plate 18. Alternatively, a partial vent cap system with a different bottom plate and without a flange assembly, can be deployed for re-attachment and sealing by the different bottom plate. The partial vent cap system may be necessary, if the pumping activity has not been completed. The seal of an emergency cap may not withstand sufficient pressure for the suction action, so that the different bottom plate may be needed by delivery on a partial vent cap system without a flange assembly. In some embodiments, the steps of separating and re-engaging the top plate 12, center stem assembly 14, retainer assembly 16, bottom plate 18 and perimeter stem assemblies 22, from and to the flange assembly 20, occurs when the vent cap system 10 is in an opened position.

In FIG. 9, an additional step of using the vent cap system 10 includes the step of actuating the threaded center stem bolt body 28 to seal the bottom plate 18 to the flange assembly 20. When the sealing means is an O-ring, there can be a step of testing seals of the O-ring at a pipe plug. The testing can happen before the pumping of water from the suction pile assembly 94 during installation. The embodiment of FIG. 3 shows the O-rings 62 and pipe plugs 68 for testing seals.

Embodiments of the present invention provide a vent cap system for a suction pile. The vent cap system has a closed position and an opened position, and an ROV can facilitate the transition between the closed position and the opened position. In the prior art, orientation of the suction pile affected the ability to open and close the vent hatch or vent cap. For a hinged cap, the horizontal orientation required the ROV to lift the cap into the closed position. The procedure required excess power and skill to manipulate the ROV under those conditions. An angle orientation causes more complicated maneuvers by the ROV for closing at an angle. The present invention can be actuated between the closed position and the opened position in both a horizontal orientation and a vertical orientation. Additionally, the same rotation of the threaded center stem bolt body opens and closes the vent cap system in both orientations and in other angled orientations. The ROV can more easily open and close the vent cap system without regard to orientation or additional power and skill requirements. The handling of the ROV is much easier with the structures and interfaces of the eye nuts and simple handles for the center stem assembly and perimeter stem assemblies.

The prior art also lacked means for testing the seal to be sufficient to withstand the necessary pressure for pumping out water and suctioning soil into the suction pile. The prior art butterfly valve has reliability problems with establishing and maintaining a proper seal. The complete closure of the butterfly valve could not be confirmed because the position of the flap of the bottom plate would be so variable. The placement of a testing port may be above or below the pivoting flap of a butterfly valve. In the present invention, the alignment of the bottom plate is assured with the bottom alignment pin. The pipe plug placement and alignment with O-rings is pre-determined, so that seals can be verified in a set relative position to the flange assembly. Additionally, the bottom alignment pin assures alignment of the bottom plate in any orientation of the vent cap system, including horizontal, vertical or angled orientations. The bottom alignment pin controls the consistency of the seal of the bottom plate to the flange assembly in any orientation and allows for testing the seals to verify the sufficiency of pressure to fully install the suction pile on the ocean floor.

The present invention is also able to adjust for failures to close and seal. The flange assembly is detachable from the remaining structures during installation on a suction. The flange assembly remains detachable at the subsea location. If the bottom plate does not close, then the bottom place can be replaced. An emergency cover can be attached. A replacement bottom plate can also be delivered on a partial vent cap system without a flange assembly. The bottom alignment pin assures proper connections and orientation, even subsea. In some cases, an emergency cap will be sufficient to close the suction pile, if completely embedded. In other cases, an emergency cap will not withstand the required pressure for the suction of the pump to complete the embedding process, so the vent cap system of the present invention provides a replacement system for a different bottom plate to re-close and re-seal and test the re-sealed suction pile. The bottom plate, and other parts, can be replaceable.

The foregoing disclosure and description of the invention is illustrative and explanatory thereof. Various changes in the details of the described method can be made without departing from the true spirit of the invention.

I claim:

1. A vent cap system, comprising:

a top plate having a center top plate hole;

a center stem assembly being comprised of a center stem handle, and a threaded center stem bolt body, said center stem handle being mounted on an end of said threaded center stem bolt body above said top plate, said threaded center stem bolt body extending through said top plate;

retainer assembly being comprised of a nut retainer plate with a retainer center hole, and a stem nut contained in said retainer center hole, said stem assembly threadedly engages said nut retainer plate in said retainer center hole;

a bottom plate being comprised of a stem retainer, a bottom alignment pin and a sealing means, said stem retainer being centered on a top surface of said bottom plate and removably attached to a terminal end of said threaded center stem bolt body, said bottom alignment pin being in alignment with said threaded center stem bolt body and said center top plate hole and extending downward from a bottom surface of said bottom plate, said sealing means being on an outer circumference of said bottom plate;

a flange assembly having a connection end and a flanged end, said connection end being oriented adjacent a suction pile for installation, said flanged end facing said bottom plate, wherein said flanged end removably engages said bottom plate, and wherein said flange assembly is comprised of a rod guide disposed within said flange assembly toward the connection end, said rod guide being comprised of a frame with a center frame hole aligned with said bottom alignment pin; and a plurality of perimeter stem assemblies, each perimeter stem assembly being arranged on a perimeter of flanged end of said flange assembly so as to maintain position of said top plate relative to said flange assembly during raising and lowering of said bottom plate between an opened position and a closed position.

2. The vent cap system, according to claim 1, wherein said center stem handle is comprised of gripping members and a housing cover, and wherein a portion of said threaded center stem bolt body above said top plate is disposed within said housing cover.

3. The vent cap system, according to claim 1, wherein said stem nut is threaded and in threaded engagement with said threaded center stem bolt body.

4. The vent cap system, according to claim 1, said retainer assembly further comprising: an eye nut having an eye nut handle and threaded eye nut body, said nut retainer plate having an eye nut hole, said threaded eye nut body extending through said eye nut hole.

5. The vent cap system, according to claim 4, wherein said eye nut handle mounts on a top side of said top plate, said top plate being positioned between said handle and said retainer assembly.

6. The vent cap system, according to claim 1, wherein said stem retainer is comprised of a flange piece in removable threaded engagement to said top surface of said bottom plate and in friction fit engagement to said terminal end of said threaded center stem bolt body.

7. The vent cap system, according to claim 1, said bottom alignment pin being made integral with said bottom plate.

8. The vent cap system, according to claim 1, wherein said sealing means comprises an O-ring on an outer circumference of said bottom plate.

9. The vent cap system, according to claim 8, wherein said sealing means comprises a plurality of O-rings, each O-ring being adjacent to another O-ring on an outer circumference of said bottom plate.

10. The vent cap system, according to claim 8, wherein said flanged end sealingly engages said bottom plate, wherein said 0-ring on said bottom plate forms a seal with said flanged end of said flange assembly.

11. The vent cap system, according to claim 1, further comprising: at least one pipe plug placed in said flanged end of said flange assembly, said at least one pipe plug forming a port for testing O-ring seals between said bottom plate and said flanged end.

12. The vent cap system, according to claim 1, wherein a plurality of rod guide mounts attach to an interior of said flange assembly to fix said rod guide in position within said flange assembly.

13. The vent cap system, according to claim 1, wherein said center frame hole is aligned with said bottom alignment pin of said bottom plate so as to insert said bottom alignment pin back and forth through said center frame hole.

14. The vent cap system, according to claim 13, wherein said frame is comprised of an outer rim, an inner rim forming said center frame hole, and a plurality of elongate members connecting inner rim to outer rim.

15. The vent cap system, according to claim 1, wherein each perimeter stem assembly is comprised of perimeter stem handle, perimeter stem bolt body, retaining screw, and a spacer, said spacer maintaining a position of said top plate relative to said flange assembly.

16. The vent cap system, according to claim 15, wherein each perimeter stem assembly has said perimeter stem bolt body with perimeter stem handle on one end, said perimeter stem handle being mounted above said top plate, said perimeter stem bolt body extending from said perimeter stem handle through said top plate.

17. The vent cap system, according to claim 15, wherein each perimeter stem assembly has said perimeter stem bolt body with an engagement end in threaded engagement with said flange assembly, said engagement end opposite said one end with said handle.

18. A method of forming a suction pile assembly with a vent cap system according to claim 1, said suction pile assembly being comprised of a generally cylindrical body with a top pile surface with vent holes on a closed end and a skirt on an opened end, said method of forming comprising the steps of:

covering a vent hole on a top pile surface with the vent cap system by placement of the connection end in alignment with said vent hole;

separating the perimeter stem assemblies from the flanged end of the flange assembly so as to separate the top plate, center stem assembly, retainer assembly, and bottom plate from the flange assembly;

making said connection end of said flange assembly integral with said closed end of said suction pile assembly;

re-engaging the perimeter stem assemblies to the flanged end of the flange assembly, said bottom alignment pin inserting through said center frame hole of said rod guide in said flange assembly so as to align said bottom plate and said flange assembly; and actuating said threaded center stem bolt body between an opened position and a closed position of the vent cap system.

19. The method of forming a suction pile assembly with a vent cap system, according to claim 18, wherein said vent cap system is in an opened position during the step of separating the top plate, center stem assembly, retainer assembly, and said bottom plate from the flange assembly and during the step of re-engaging the perimeter stem assemblies to the flanged end of the flange assembly.

20. The method of forming a suction pile assembly with a vent cap system, according to claim 18, wherein the step of actuating said threaded center stem bolt body lowers said bottom plate to engage said flanged end of said flange assembly, said vent cap system being in a closed position, forming a seal with said sealing means on said bottom plate.

* * * * *